United States Patent [19]

Wedge et al.

[11] Patent Number: 4,493,309

[45] Date of Patent: Jan. 15, 1985

[54] FUEL FIRED HEATING ELEMENT

[75] Inventors: Philip J. Wedge, Cheswick Green; Robert C. Bridson, Shirley, both of England

[73] Assignee: British Gas Corporation, London, England

[21] Appl. No.: 536,309

[22] Filed: Sep. 27, 1983

[30] Foreign Application Priority Data

Sep. 29, 1982 [GB] United Kingdom ..... 8227707

[51] Int. Cl.[3] ..... F24C 3/00

[52] U.S. Cl. ..... 126/91 A; 126/360 R; 431/116; 431/158; 431/215; 431/243; 239/129; 239/427.3

[58] Field of Search ..... 431/5, 116, 115, 114, 431/158, 187, 211, 215, 239, 243; 126/91 A, 360 R; 60/725, 736, 750, 758; 239/129, 425, 138, 426, 139, 543, 427.3

[56] References Cited

U.S. PATENT DOCUMENTS

| | | | |
|---|---|---|---|
| 2,857,961 | 10/1958 | Brown et al. | 431/116 |
| 3,266,485 | 8/1966 | Girton | 126/360 R |
| 3,285,240 | 11/1966 | Schmidt | 431/215 X |
| 4,306,858 | 12/1981 | Simon | 431/215 X |
| 4,308,007 | 12/1981 | Buschulte | 431/116 |

FOREIGN PATENT DOCUMENTS

| | | | |
|---|---|---|---|
| 2165172 | 7/1972 | Fed. Rep. of Germany | 126/91 A |
| 537637 | 7/1941 | United Kingdom | 126/91 A |
| 1442128 | 7/1976 | United Kingdom | 431/116 |

*Primary Examiner*—Randall L. Green
*Attorney, Agent, or Firm*—Larson and Taylor

[57] ABSTRACT

The present invention relates to a fuel-fired heating element of the tubular kind particularly though not exclusively for use as an immersed heating tube in molten metals, salts or fluidized beds of solid particles for conductive heating or for use in an enclosed or partially enclosed chamber to provide radiant and convective heating.

The element includes a tubular housing 1 having one end 2 closed and an opening to provide an outlet 4 for combustion products. A burner assembly 6 is received with an annular clearance 51 within the housing between the outlet 4 and the closed end 2 and is arranged to direct its combustion products as a stream towards the closed end 2.

The tube 7 encloses with clearance three axially aligned tubes 60, 61 and 62 whose external and internal diameters decrease sequentially from the burner 6 to the end 2.

The combustion products are conveyed by the ducts from the burner 6 to the closed end 2 and back again with some re-conveyed products re-entering the duct 60 while the remainder leave by way of the clearance between the burner 6 and the tube 7. Some of the products conveyed from the burner 6 to the closed end 2 are drawn into the returning stream by way of the gap between the ducts.

7 Claims, 1 Drawing Figure

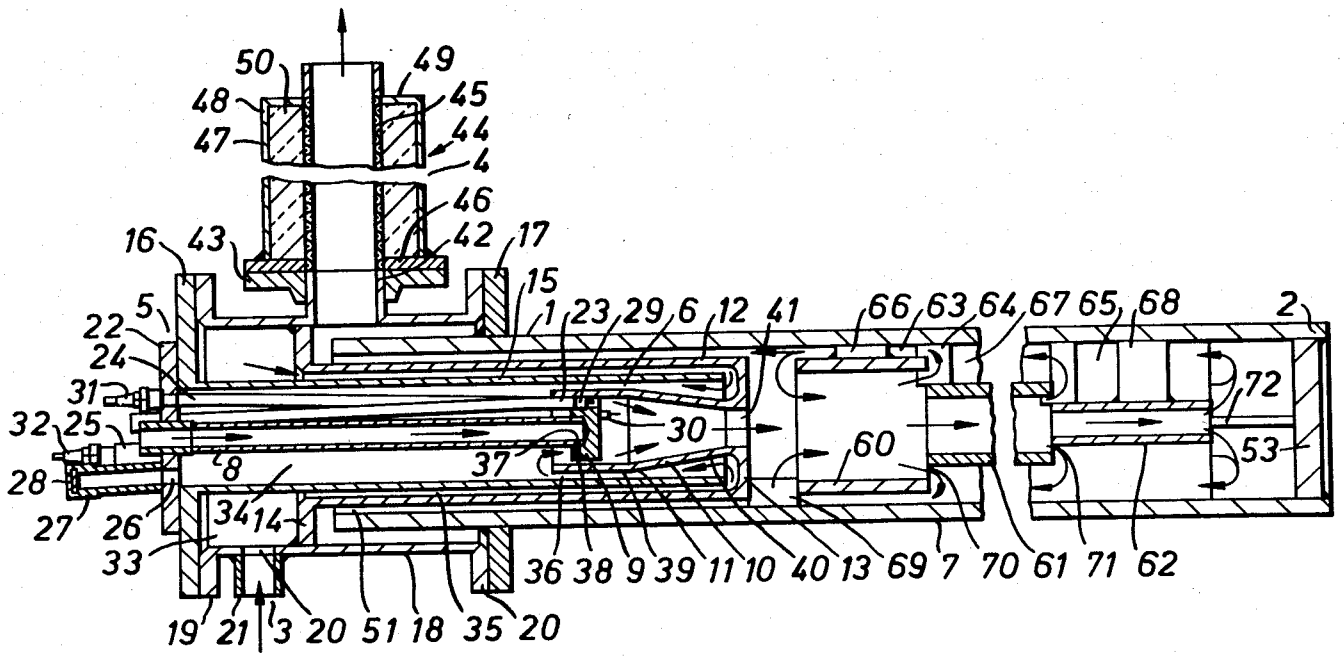
2
72
53
68
65
67
62
71
61
64
63
70
7
66
60
69
13
40
41
10
12
11
6
30
39
29
9
23
38
1
36
15
37
17
20
35
45
44
4
46
42
18
49
51
20
3
50
14
34
8
48
47
43
21
19
16
5
22
24
31
25
26
33
32
28
27

FUEL FIRED HEATING ELEMENT

FIELD OF THE INVENTION

The present invention relates to a fuel-fired heating element of the tubular kind particularly though not exclusively for use as an immersed heating tube in molten metals, salts or fluidised beds of solid particles for conductive heating or for use in an enclosed or partially enclosed chamber to provide radiant and convective heating.

SUMMARY OF THE INVENTION

According to the present invention, there is provided a fuel-fired heating element including a tubular housing having one end closed and an opening to provide an outlet for combustion products, a burner assembly received with clearance within the housing between the outlet and the closed end and arranged to direct its combustion products towards the closed end of the housing, and a duct received with clearance within the housing and spaced from the closed end of the housing to convey the combustion products leaving the burner as a central stream towards the closed end of the housing and as a contiguous outer stream within the clearance between the duct and the housing in the opposite direction towards the burner assembly, the duct being adapted to permit part of the central stream to discharge into and directly against the flow of the outer stream before the central stream reaches the closed end of the housing.

BRIEF DESCRIPTION OF THE DRAWING

An embodiment of the invention will now be particularly described with reference to the accompanying drawing which is a diagrammatic longitudinal sectional view of a form of the heating element.

DESCRIPTION OF THE PREFERRED EMBODIMENTS

Referring to the drawing, the heating element comprises a tubular housing 1 having a closure at one end 2, an inlet 3 for air and an outlet 4 for waste combustion products adjacent to its other end 5 together with a burner assembly 6 received with clearance within the housing 1.

The housing 1 comprises an external ceramic or metallic elongate duct or tube 7 which is closed at its end 2.

Extending into the tube 7 through its other end 5 is the burner assembly 6.

The assembly 6 comprises a fuel supply duct 8 for supplying fuel, in this case gas, to a fuel supply nozzle 9 mounted at the forward end of the duct 8 and a tunnel 10 into the rear end of which the nozzle 9 and the duct 8 extend with clearance.

The tunnel 10 comprises a central portion 11 which provides a combustion chamber for a mixture of fuel and air and an outer duct 12 forming a sleeve for the central portion 11 and joined to the central portion 11 by means of an annular front wall 13, the duct 12 terminating at its other end in a flange 14. Extending into the annular clearance formed between the central portion 11 of the tunnel 10 and its outer sleeve 12 is a further duct 15 which terminates at one end short of the front wall 13 and at its other end in a flange 16 located beyond the flange 14 of the sleeve 12. Secured between the flange 16 and a further flange 17 circumventing the external wall of the tube 7 and secured by welding thereto is a short sleeve 18 with flanges 19 and 20 respectively for engaging the flanges 16 and 17. The internal wall of the short sleeve 18 is welded to the flange 14 at some point intermediate its length. On the side of the slange 14 further from the burner nozzle 9 the sleeve 18 is provided with an opening 20 leading to a stub pipe 21 which is welded to the sleeve 18.

Secured to the flanged end 16 of the further duct 15 is an apertured disc 22 for forming a closure to the end 16. Extending through various apertures in the disc 22 and through the further duct 15 are respectively the fuel supply duct 8, a conventional pilot fuel tube 23, a conventional ignition electrode 24 for the pilot tube 23 and a conventional electrically operated flame detection probe 25. Extending outwardly from another aperture 26 in the disc 22 is a conventional flame sighting tube 27 secured to the disc and provided with a suitably coloured sighting glass 28.

The pilot tube 23 and the electrode 24 whose tip 29 is visible in FIG. 1 are mounted at their forward ends on the nozzle 9 in a recess therein.

The probe 25 extends through an aperture (not shown) in the body of the nozzle 9 and its tip 30 terminates within the central portion 11 of the tunnel 10. The terminals 31 and 32 respectively of the electrode 24 and the probe 25 are shown mounted externally of the duct 15.

The stub pipe 21 forms an inlet for supplying air to the annular chamber 33 formed between the flanges 14 and 16, the duct 15 and the sleeve 18 respectively while the duct 15 forms with the disc 22 a further annular chamber 34 around the fuel supply duct 8 for supplying the air to the central portion 11 of the tunnel 10.

The chambers 33 and 34 are connected by means of an annular passageway 35 which is formed between the outer duct 12 and the further duct 15 and another annular passageway 36 which interconnects with the passageway 35 and is formed between the further duct 12 and the external wall of the central portion 11 of the tunnel 10.

The fuel supply duct 8 is provided at its forward end with several circumferentially spaced apertures 37 which correspond with the same number of circumferentially spaced and radially directed ports 38 extending through the body of the fuel supply nozzle 9 to communicate with the annular clearance between the nozzle 9 and the central section 11 of the tunnel 10.

The central section 11 of the tunnel 10 comprises a rearward cylindrical portion 39 into which the nozzle 9 and duct 8 extend with clearance and a forward conically tapering portion 40 which is adapted to accelerate the combustion products of fuel and air issuing through the tunnel outlet 41 from the cylindrical portion 39. The portion 40 can of course be cylindrical rather than tapering if necessary.

On the side of the flange 14 near to the burner nozzle 9, the sleeve 18 is provided with an integral pipe 42 extending radially therefrom, the pipe 42 having a circumferential flange 43 to which is secured a silencer 44. The pipe 42 forms an outlet for waste combustion products while the silencer 44 provides means for reducing the noise of the exhaust.

The silencer 44 comprises a central apertured pipe 45 to one end of which is secured circumferentially an annular flange 46. The pipe 42 is circumvented by a tubular housing 47 which has a tubular wall 48 secured at one end by welding to the flange 46 and having at its other end an annular disc 49 received on and welded to the pipe 45. The housing 47 contains a heat insulating and sound absorbing material 50.

The outlet 42 communicates with an annular passageway 51 formed between the tube 7 and the outer duct 12 for the passage of exhaust combustion products from the far end of the housing to and out of the housing by way of the outlet 42.

Three axially aligned stub pipes or tubes 60,61 and 62 are located within the housing and are spaced with clearance from the outer face tube to form respectively annular passageways 63,64 and 65 which are contiguous.

Each stub pipe is provided with a set of fins 66,67 and 68 respectively which are welded to the pipes to space the pipes from the tube 7 to form the passageways. While not shown, each set of fins comprises three circumferentially equi-spaced fins.

Stub pipe 60 is spaced from the burner outlet 41 by means of one or more further circumferentially equi-spaced fins 69 which are welded to the end of the pipe 60. The internal diameter of stub pipe 60 is considerably greater than the diameter of the tunnel outlet 41 so that the combustion products leaving the tunnel outlet 41 can all enter the stub pipe 60 as a central stream.

The internal diameter of the stub pipe 60 is greater than the external diameter of the stub pipe 61 so that an annular opening 70 is formed between the pipes 60 and 61 to permit a proportion of the central stream of combustion products travelling along pipe 60 to enter the annular passageway 64 while the remainder enter the next stub pipe 62.

Similarly the internal diameter of the stub pipe 61 is greater than the external diameter of the stub pipe 62 so that an annular opening 71 is formed between the pipes 61 and 62 to permit a proportion of the central stream of combustion products travelling along the pipe 61 to enter the annular pasageway 65 while the remainder enter the next stub pipe 63.

The stub pipe 62 is spaced from the closure disc 53 by means of three or more circumferentially equi-spaced fins 72 which are welded to the end of the pipe 62.

In use of the element shown, the air for use in combustion enters the chamber 33 by way of the air inlet pipe 21. The air is then forced to flow along the annular passageway 35 towards the front wall 13 of the tunnel 10. Simultaneously, hot combustion gas is flowing in the opposite direction towards the outlet 4 along the annular passageway 51 so that there takes place across the wall of the duct 12 intermediate the passages 35 and 51 a transfer of heat from the stream of combustion products to the air. The now hotter air after reaching the front wall 13 of the tunnel 10 reverses its direction to flow along the annular passageway 36 towards the chamber 34. Simultaneously, the stream of combustion products produced by the combustion of fuel and air is leaving the tunnel 10 in a direction opposite to that in which the air flows in passageway 36. Transfer of heat therefore takes place across the tunnel wall and between the air flowing in passageway 36 which becomes still hotter and the exhaust gas in the combustion chamber in the tunnel 10 which is thereby cooled by the air.

The now preheated air then leaves the passageway 36 and enters the chamber 34 where it is forced to flow towards the fuel nozzle 9 and into the tunnel 10 by way of the clearance between the nozzle 9 and the rear portion 39 of the central tunnel section 11.

Simultaneously fuel in the form of fuel gas is conveyed along the fuel supply duct 8 towards the nozzle 9 and thence by way of the radial ports into the annular clearance between the nozzle 9 and the tunnel section 11 as several streams. The streams of fuel gas meet and mix with the air in the clearance and the fuel gas and air enter the tunnel 10 as a mixture.

The mixture is ignited by gas issuing from the pilot tube 23, the gum itself previously ignited by the electrode 24. After ignition the gas mixture burns within the rear cylindrical portion 39 of the tunnel 10.

The probe 25 can be used to detect whether ignition has occurred. Alternatively or in addition the flame can be viewed through the sight-glass which is lined up with an aperture (not shown) extending through the body of the nozzle 9.

The combustion products leaving the tunnel burner 10 are accelerated in the conical portion 40 thereof before entering the stub pipe 60 as the central stream.

The central stream is conveyed along the stub pipe 60 and a part of the stream escapes from the pipe 60 into the annular passageway 64 by way of the annular opening 70.

The remainder of the central stream of combustion products enters the next stub pipe 61 and is conveyed therealong. A part of this stream also escapes into the annular passageway 65 by way of the annular opening 71.

The remainder of the original central stream of combustion products is conveyed along the stub pipe 62 towards the closure disc 53 and after impinging upon this is forced to travel in the opposite direction as an outer stream along the passageway 65 and subsequently along the passageways 64 and 63.

Upon entering the passageway 64, the return stream entrains that part of the central stream escaping through the annular opening 71 directly against the flow of the outer stream and these entrained products and the stream are further conveyed along the passageway 64.

Upon entering the passageway 63, the stream then entrains that part of the central stream escaping through the annular opening 70 directly against the flow of the outer stream and these entrained products and the outer stream are then further conveyed along the passageway 63.

Upon reaching the burner end of the passageway 63 a proportion of the now fully augmented stream of combustion products is entrained by the high velocity stream of combustion products leaving the tunnel outlet 41 to re-enter the stub pipe 60. These additional gases mix with the initial gas stream issuing from the tunnel to form a larger mass flow rate of cooler gases. This improves the rate of heat transfer across the stub pipes 60,61 and 62 from the combustion products in the passageways 63,64 and 65 to those conveyed along the pipes 60,61 and 62.

The rate of heat transfer across the stub pipes 61 and 62 is additionally improved by the mixing of gases which takes place between those gases entering the annular passageways 64 and 63 by way respectively of the openings 71 and 70 and the initial stream of gases travelling along the passageways 65 and 64. An additional enhancement to the mass flow rate of the cooler gases is thereby produced.

The remainder of the combustion gases then, leave the passageway 64 to enter the passageway 51 between the tube 7 and the outer duct 12 and travel towards and through the outlet 44.

We claim:

1. A fuel-fired heating element including a tubular housing having one end closed and an opening to provide an outlet for combustion products, a burner assembly received with clearance within the housing between the outlet and the closed end and arranged to direct its combustion products towards the closed end of the housing and a duct received with clearance within the housing to convey the combustion products leaving the burner as a central stream towards the closed end of the housing and as contiguous outer stream within the clearance between the duct and the housing in the opposite direction towards the burner assembly, the duct comprising a plurality of axially aligned tubes, each tube being spaced from the tube adjacent thereto and the tubes being so dimensioned that in a direction downstream of the burner assembly, the upstream tube has an internal diameter greater than the external diameter of the adjacent downstream tube to permit a part of the central stream to discharge into and directly against the flow of the outer stream through the space between corresponding tube pairs.

2. An element as claimed in claim 1 in which the tube immediately adjacent to the burner assembly is spaced therefrom to permit part of the outer stream to re-enter the central stream between the space between the burner assembly and the tube before the outer stream leaves the outlet.

3. An element as claimed in claim 1 in which the housing has an opening to provide an inlet for air for supply to the burner assembly and means, including an air duct received with clearance within the housing for conveying the air from the inlet to the burner assembly, the clearance providing a passageway leading from the burner to the outlet for conveying exhaust combustion products to the outlet so that a transfer of heat can take place through the wall between the incoming air before the air reaches the burner assembly and the outgoing combustion products before these products reach the outlet.

4. An element as claimed in claim 3 in which the burner assembly includes a combustion chamber into which fuel and the air are supplied for combustion and the means for conveying air to the assembly is arranged to form a passageway around the wall of the combustion chamber so that a transfer of heat can take place through the wall of the combustion chamber between the combustion products before the products leave the combustion chamber and the air before the air enters the combustion chamber.

5. An element as claimed in claim 1 in which the outlet opening in the housing is formed in a further duct adapted to absorb noise of emission of the combustion products from the housing.

6. An element as claimed in claim 1 in which the burner assembly comprises a combustion chamber which has a conically tapering portion leading to the outlet to accelerate the combustion products into a high velocity jet.

7. An element as claimed in claim 1 in which the tubular housing is constructed of corrosion material resistant to molten metal.

* * * * *